US007127762B1

(12) United States Patent
Lau

(10) Patent No.: US 7,127,762 B1
(45) Date of Patent: Oct. 31, 2006

(54) INFLATABLE PRODUCT WITH STOWABLE PUMP

(75) Inventor: Vincent W. S. Lau, Sai Kung (HK)

(73) Assignee: Ideal Time Consultants Limited, Tortola (VG)

( * ) Notice: Subject to any disclaimer, the term of this patent is extended or adjusted under 35 U.S.C. 154(b) by 0 days.

(21) Appl. No.: 11/128,019

(22) Filed: May 12, 2005

(51) Int. Cl.
*A47C 27/08* (2006.01)

(52) U.S. Cl. ..... 5/713; 5/706; 5/655.3

(58) Field of Classification Search ..... 5/706, 5/708, 713, 655.3; 417/410.1, 423.1, 238–239, 417/361
See application file for complete search history.

(56) References Cited

U.S. PATENT DOCUMENTS

| | | | |
|---|---|---|---|
| 2,498,270 | A | 2/1950 | Hawley |
| 3,670,440 | A | 6/1972 | Yost |
| 4,390,226 | A | 6/1983 | Hohn |
| 4,619,481 | A | 10/1986 | Grudzinskas |
| 4,678,014 | A | 7/1987 | Owen et al. |
| 4,702,235 | A | 10/1987 | Hong |
| 4,766,628 | A | 8/1988 | Walker |
| 4,862,533 | A | 9/1989 | Adams, III |
| 4,862,921 | A | 9/1989 | Hess |
| 4,890,344 | A | 1/1990 | Walker |
| 4,977,633 | A | 12/1990 | Chaffee |
| 4,990,060 | A | 2/1991 | Cheng-Chung |
| 5,006,082 | A | 4/1991 | Hwang |
| 5,020,517 | A | 6/1991 | Foster, Jr. et al. |
| 5,068,933 | A | 12/1991 | Sexton |

(Continued)

FOREIGN PATENT DOCUMENTS

| | | |
|---|---|---|
| JP | 3289039 | 12/1991 |

*Primary Examiner*—Patricia Engle
*Assistant Examiner*—Fredrick Conley
(74) *Attorney, Agent, or Firm*—Schweitzer Cornman Gross & Bondell LLP

(57) ABSTRACT

An inflatable product has a socket disposed in a wall of an inflatable body and extending into an interior of the inflatable body. A pump is slidably disposed in the socket, and is slidable from a retracted position to an extended position. The retracted position defines an insertion limit of the pump into the socket, and the extended position defines a withdrawal limit of the pump from the socket. The pump is operable to inflate the inflatable body when in the extended position. The pump includes a power source connected to a fan, operable to inflate the inflatable body. The pump includes a switch operable to activate the fan when in a closed position. The switch is in an the closed position when the pump is in the extended position, and in an open position when the pump is in the retracted position. The pump includes an air intake in fluid communication with ambient air when the pump is in the extended position, and the air intake is sealed from the ambient air when the pump is in the retracted position. The socket includes an outlet in fluid communication with an interior of the inflatable body, and, when the pump is in the extended position, the socket and the pump define a sealed conduit fluidly connecting an outlet of the pump to the outlet of the socket to inflate the body indirectly via the sealed conduit. The socket has an opening through which the pump extends and the opening is substantially sealed by the pump. The pump seals the outlet of the socket when the pump is in the retracted position. Detent projections and recesses releasably maintain the pump in the extended position. A battery is removable when the pump is in the extended position.

32 Claims, 4 Drawing Sheets

U.S. PATENT DOCUMENTS 5,127,808 A 7/1992 Nichols et al.
5,170,522 A 12/1992 Walker
5,249,319 A 10/1993 Higgs
5,267,363 A 12/1993 Chaffee
5,293,707 A 3/1994 Shaeffer
5,367,726 A 11/1994 Chaffee
5,452,753 A 9/1995 Olney
5,503,618 A 4/1996 Rey
5,518,436 A 5/1996 Lund et al.
5,522,337 A 6/1996 Meyers et al.
5,542,136 A 8/1996 Tappel
5,598,593 A 2/1997 Wolfe
5,605,482 A 2/1997 Choy
5,639,076 A 6/1997 Cmiel et al.
5,687,438 A 11/1997 Biggie et al.
5,711,041 A 1/1998 Chen
5,746,873 A 5/1998 Graf
5,755,634 A 5/1998 Huang
5,771,514 A 6/1998 Wilhoit
5,890,882 A 4/1999 Feldman
5,902,003 A 5/1999 Hindson
5,931,207 A 8/1999 Gianino
5,941,272 A 8/1999 Feldman
5,970,661 A 10/1999 Bishop et al.
6,004,116 A 12/1999 Wang
6,012,826 A 1/2000 Chabert
6,014,784 A 1/2000 Taylor et al.
6,253,401 B1 7/2001 Boyd
6,287,095 B1 9/2001 Saputo et al.
6,332,760 B1 12/2001 Chung
6,457,192 B1 10/2002 Choi et al.
RE37,983 E 2/2003 Wang
6,543,073 B1 4/2003 Wu
6,591,437 B1 7/2003 Phillips
6,722,306 B1 4/2004 Wang
6,733,254 B1 5/2004 Yen
6,793,469 B1 9/2004 Chung
6,836,914 B1 1/2005 Tsai
6,955,527 B1 * 10/2005 Yen ..... 417/411
2001/0044969 A1 11/2001 Chaffee
2004/0117912 A1 6/2004 Chung
2004/0123394 A1 7/2004 Wang
2004/0123395 A1 7/2004 Wang
2004/0123396 A1 7/2004 Wang
2004/0244116 A1 12/2004 Chung

* cited by examiner

INFLATABLE PRODUCT WITH STOWABLE PUMP

FIELD OF THE INVENTION

The invention pertains to the field of inflatable products and, in particular, inflatable products incorporating a pump.

BACKGROUND AND SUMMARY OF THE INVENTION

Inflatable products, such as inflatable air mattresses and the like typically include an air pump for inflation and, in some cases, deflation of an inflatable body. Some inflatable products also include a socket in the inflatable body for receiving or storing the pump. Such designs are suitable for some purposes. However, the present invention avoids certain drawbacks of such prior designs and incorporates substantial improvements.

The inflatable product of the present invention includes an inflatable body, such as an air mattress, which includes a flexible body wall. A rigid socket is disposed in the body wall and extends into an interior volume of the inflatable body.

The socket includes a socket opening which may be flush with the body wall. The socket also includes side walls aligned substantially perpendicular to the socket opening. In addition, the socket includes an innermost end wall aligned substantially parallel to the socket opening.

The socket includes a socket outlet located on the end wall, which socket outlet is in fluid communication with an interior volume of the inflatable body. A one-way valve is disposed over the socket outlet to permit ingress of air into the interior volume of the inflatable body through the socket outlet and to prevent egress of air out the socket outlet. The inflatable product preferably includes a user-operable deflation valve which is located on the body wall.

The socket forms a recess in which an air pump is slidably disposed. The pump has a retracted position, an extended position and intermediate positions wherein the pump is intermediate the retracted and extended positions. The pump includes a handle on an outward face suitable to permit a user to grasp and pull the pump from the retracted position to the extended position.

The pump is substantially entirely within the socket when in the retracted position and is substantially entirely outside the socket when in the extended position. The pump includes a pump outlet on an inward face which is in fluid communication with an interior of the socket when the pump is in the extended position, or in an intermediate position.

The socket opening is substantially sealed by the pump to prevent pressurized air injected into the interior of the socket by the pump from escaping. The pump includes an air intake opening which is in fluid communication with ambient air outside the inflatable body when said pump is in the extended or intermediate positions. The pump includes a fan in fluid communication with the air intake and pump outlet whereby the fan is operable to force pressurized air into the interior of the socket to inflate the inflatable body. The fan is electrically connected to a power source in series with a switch, which switch is operable to activate the fan when in a closed (on) position. The switch is biased into an open (off) position by a resilient member, such as a spring, or the like, when the pump is in a deactivated position. The switch is in the closed position when the pump is in an activated position. In this manner, the pump is automatically activated, without further action by the user when the pump is moved to an activated position. The extended position of the pump is preferably an activated position.

The pump has a sealing position in which the pump substantially blocks, closes or seals the socket outlet and substantially prevents egress of air from the inflatable body through to socket outlet. The pump has a displaced position in which the pump is substantially displaced from the socket outlet where the pump allows ingress of air into the inflatable body.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF PREFERRED EMBODIMENTS

Figure 1:
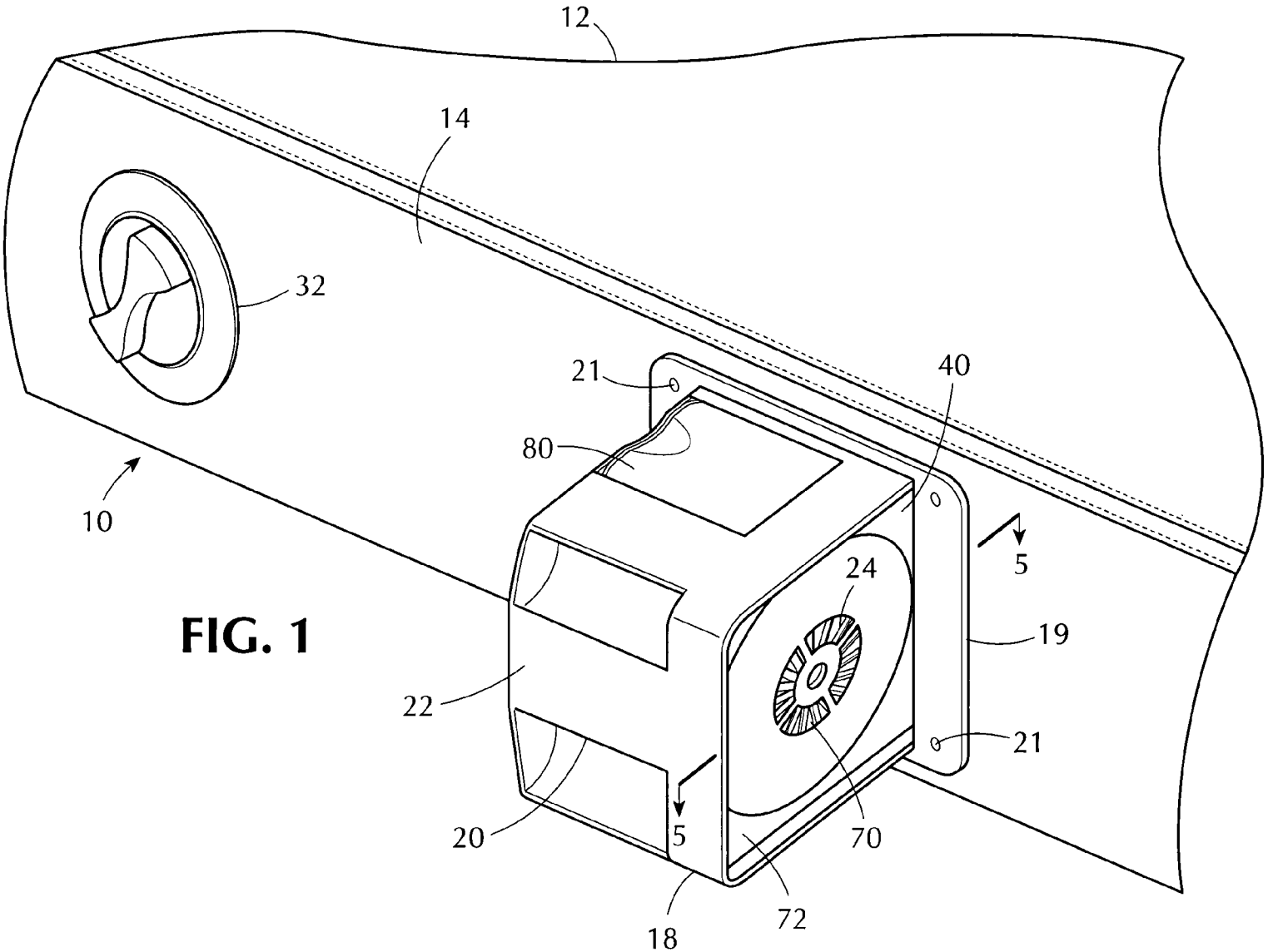
FIG. 1 is a perspective view of an inflatable body constructed according to the invention showing the pump in the extended position.
Figure 2:
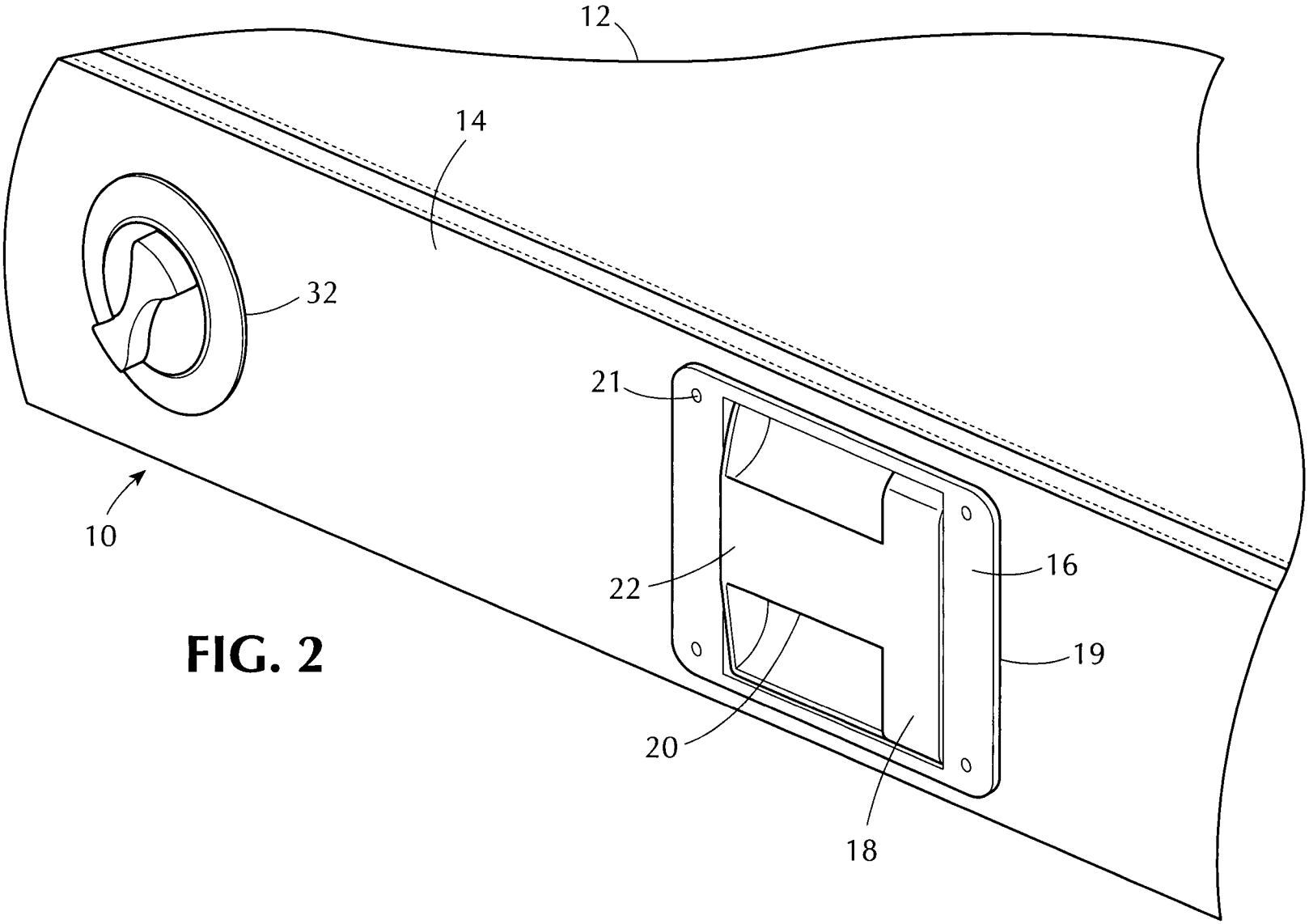
FIG. 2 is a perspective view of the inflatable body of FIG. 1, showing the pump in the retracted position.
Figure 4:
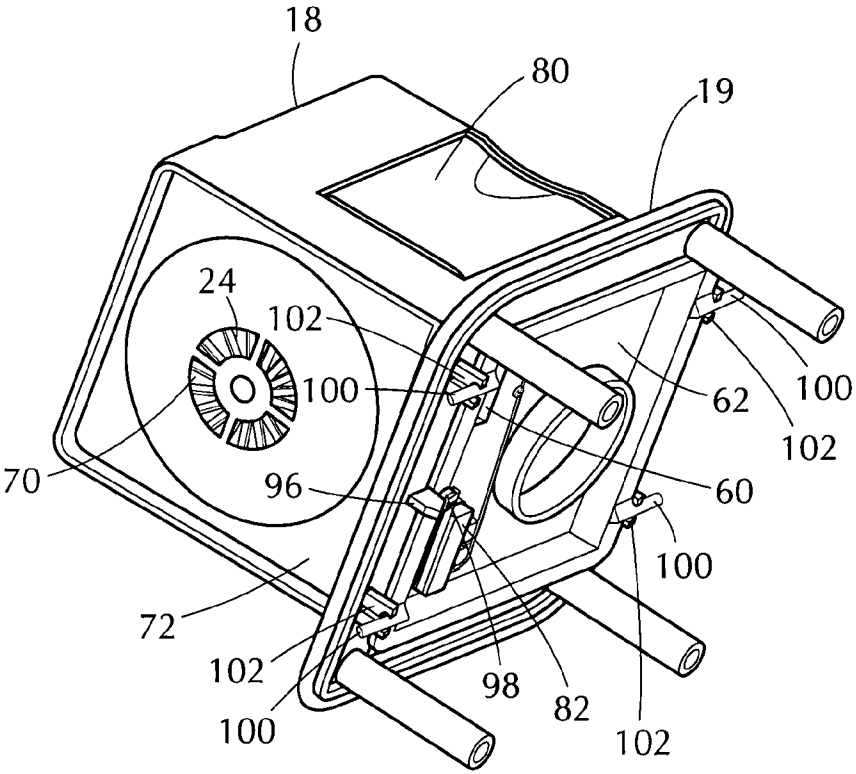
FIG. 4 is a perspective view of the assembly of FIG. 3, showing the pump in the extended position.
Figure 3:
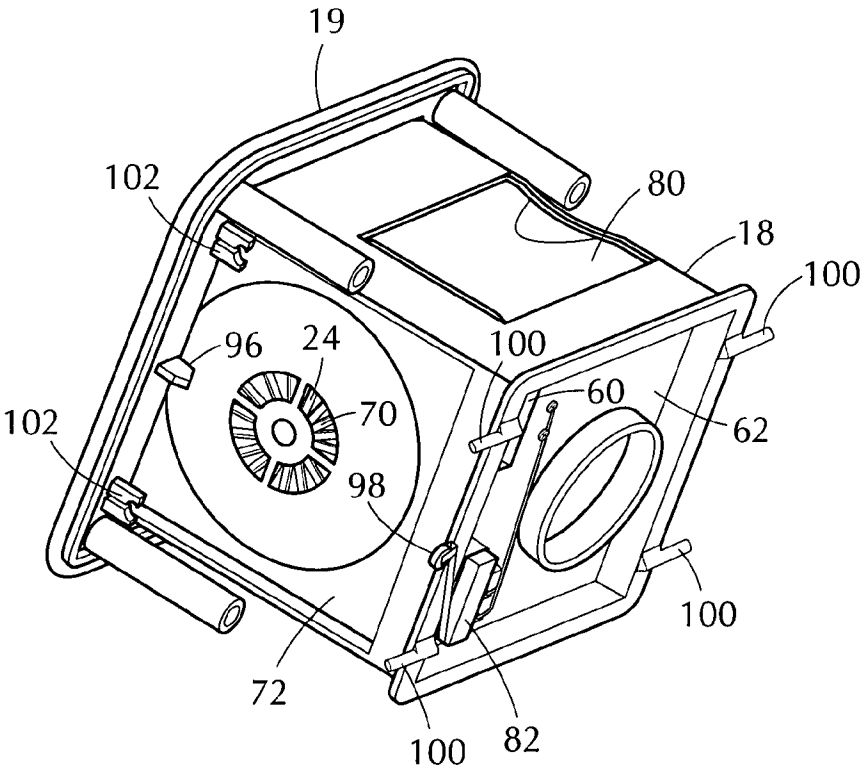
FIG. 3 is a perspective view of an assembly of a pump and socket end plate, showing the pump in the retracted position.
Figure 5:
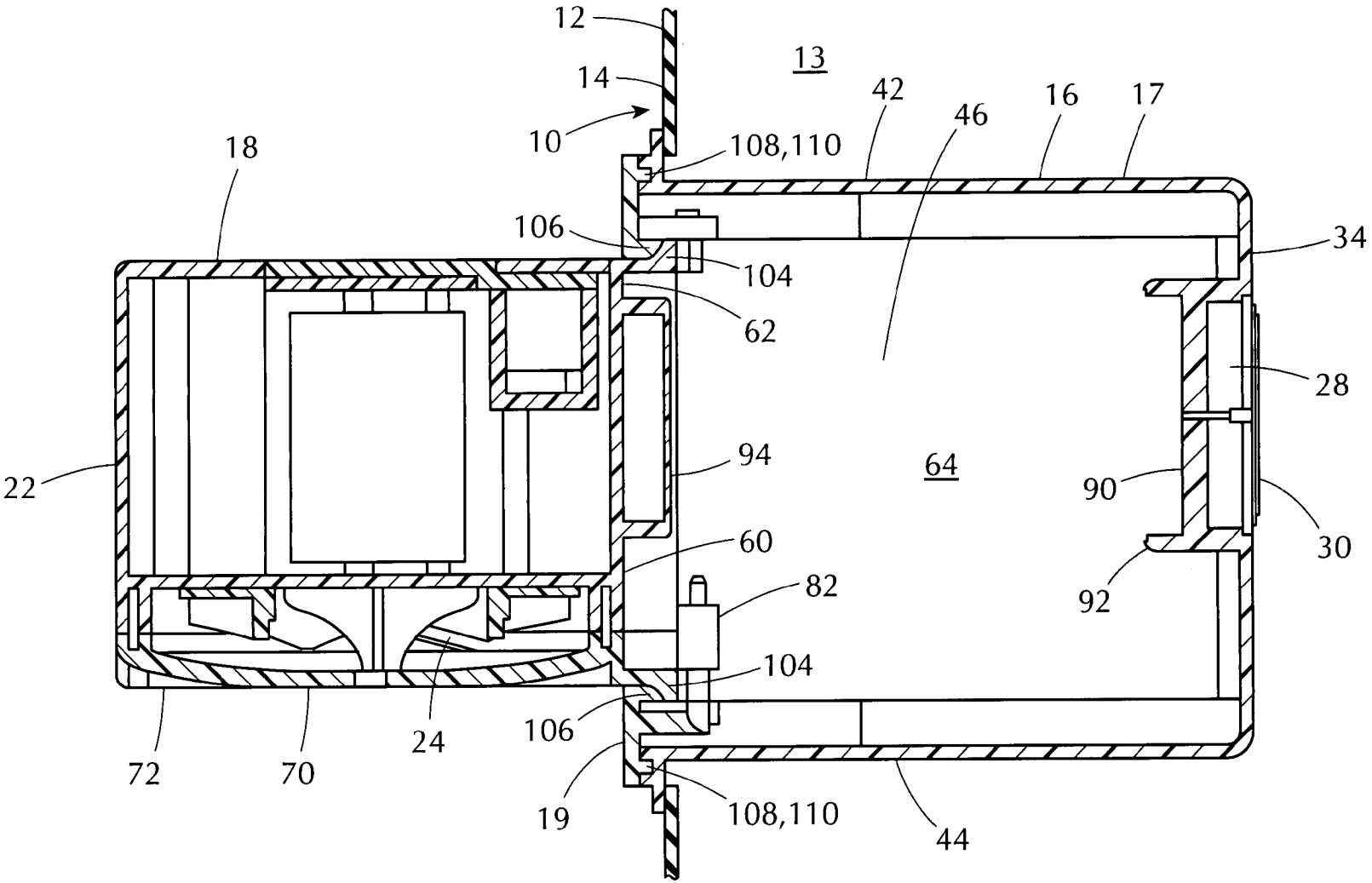
FIG. 5 is a cross-sectional view of the inflatable body, taken along line 5—5 of FIG. 1.

Referring to FIGS. 1–5, the inflatable product 10 of the present invention includes an inflatable body 12, such as an air mattress, air bed, or the like, or another inflatable product. The inflatable body includes a flexible body wall 14 defining a boundary which is substantially or entirely impermeable to air. A socket 16 is disposed in the body wall 14 and extends into an inflatable, interior volume 13 of the inflatable body 12.

Preferably, the socket 16 includes a rigid, five-sided socket housing 17 which extends into the interior volume 13 of the inflatable body 12, and includes a rigid socket end plate 19 affixed to the socket housing 17 by fasteners 21, such as screws or the like. The socket housing 17 and/or end plate 19 are sealingly affixed to a periphery of an opening in the body wall 14 such that pressurized air within the interior 13 of the inflatable body 12 cannot escape through the opening in the body wall 14.

The end plate 19 of the socket 16 has an inner periphery that defines the socket opening 40 through which the pump 18 extends when the pump 18 is in the extended and intermediate positions.

The socket housing 17 includes a peripheral recess 108 which is sized and shaped to closely, sealingly receive a peripheral projection 110 of the socket end plate 19 to prevent the escape of pressurized air through the junction of the socket end plate 19 and socket housing 17.

Preferably, the socket end plate 19 and socket opening 40 are substantially flush or substantively co-planar with the body wall 14. The socket housing 17 includes one or more side walls 42, 44, 46, 48 preferably aligned substantially perpendicular to the socket opening 40 and/or said wall 14. In addition, the socket housing 17 includes an innermost or end wall 34, preferably aligned substantially parallel to the socket opening 40 and/or body wall 14. The socket housing 17 and socket end wall 19 are formed of relatively rigid and durable material, such as a rigid plastic material; however, other similar materials are within the scope of the invention.

The socket housing 17 includes a socket outlet 28 which is in fluid communication with the interior volume 13 of the inflatable body 12. The socket outlet 28 is preferably located on the innermost wall 34 of the socket housing 17. Preferably, a one-way valve 30, or the like, is disposed over the socket outlet 28 to permit ingress of air into the interior volume 13 of the inflatable body 12 through the socket outlet 28 and to substantially prevent egress of air out of such interior volume 13 through the socket outlet 28. The inflatable product 10 preferably includes a user-operable deflation valve or opening 32, independent of the socket housing 17, which is located on the body wall 14 or another wall.

The socket 16 forms a recess in which an air pump 18 is slidably disposed. The pump 18 has a retracted position (FIGS. 2 and 3) which is defined by an insertion limit of the pump 18 into the socket 16. The pump 18 also has an extended position (FIGS. 1, 4 and 5) which is defined by a withdrawal limit of the pump 18 from the socket 16. Preferably, the socket 16 and/or pump 18 include a stop (described below) to prevent detachment of the pump 18 from the socket 16 and inflatable body 12. Further, the pump 18 has intermediate positions wherein the pump 18 is intermediate said retracted and extended positions.

The pump 18 preferably includes a handle, grip or recess 20 on an outward face 22 thereof suitable to permit a user to grasp and pull the pump 18 from the retracted position, through the intermediate positions to the extended position. As can be appreciated, the user may move the pump 18 back into the retracted position by pushing on the outward face 22 of the pump 18. Preferably, the socket 16 has a substantially constant cross-section complementary to a similar cross-section of the pump 18, as taken perpendicular to a direction of travel of the pump 18 within the socket. As depicted, both the socket 16 and pump may have substantially square or rectangular cross-sections. However, other cross-sectional shapes, such as circular or oval or other shapes are contemplated by the invention.

Preferably, the pump 18 is substantially entirely within the socket 16 when in the retracted position with the outward face 22 of the pump 18 preferably substantially flush or substantially co-planar with the body wall 14, socket opening 40 and/or socket end plate 19. Preferably, the pump 18 is substantially entirely outside the socket housing 17 when in the extended position. However, a portion of a housing of the pump 18 may remain within the socket housing 17 when the pump is in the extended position.

The pump 18 includes a pump outlet 60 on an inward face 62 of the pump 18. The pump outlet 60 is in fluid communication with an interior volume 64 of the socket 16 when the pump 18 is in the extended position, or in an intermediate position.

Preferably, the socket opening 40 is substantially sealed by the pump 18 to prevent pressurized air injected into the interior volume 64 of the socket 16 through the pump outlet 60 from escaping from the socket 16 around an exterior of the pump 18. Such sealing of the socket opening 40 may occur when the pump 18 is in the extended, retracted and/or intermediate positions.

The socket end plate 19 includes a radially, inwardly-extending peripheral sealing flange 106. The pump 18 includes a complementary. outwardly-extending, peripheral sealing flange 104 projecting radially outwardly from the inward end 62 of the pump 18. The sealing flange 104 of the pump 18 is located intermediate the sealing flange 106 of the socket end plate 19 and the end wall 34 of the socket housing 17.

When the pump 18 is in the extended position, the complementary sealing flanges 104, 106 of the pump 18 and socket end plate 19 are in sealingly abutting contact to substantially seal the socket opening 40. Optionally, either or both the sealing flanges 102, 104 may include resilient sealing material suitable to tighten the seal of the socket opening 40. As can be appreciated, the sealing flanges 104, 106 also serve as a stop to define the withdrawal limit of the pump 18 and to prevent the pump 18 from being detached from the socket 16.

When the pump 18 is in the extended or intermediate positions, the pump 18 and socket 16 define a sealed conduit fluidly connecting the pump outlet 60 to the socket outlet. Thus, the pump 18 is operable to inflate the inflatable body 12 indirectly via the sealed conduit.

The pump includes an air intake opening 70 which is in fluid communication with ambient air outside the interior volume 13 of the inflatable body 12 when said pump 18 is in the extended or intermediate positions. Preferably, the air intake 70 is disposed on a side wall 72 of the pump 18, which side wall 72 is located intermediate the inward and outward faces 62, 22 of the pump 18. The pump 18 includes a fan 24 in fluid communication with the air intake 70 and pump outlet 60 whereby the fan 24 is operable to force pressurized air into the interior of the socket 16 to inflate the inflatable body 12. The fan 24 is electrically connected to the power source in series with a switch 82, which switch 82 is operable to activate the fan when the switch 82 is in a closed (on) position.

Preferably, the air intake 70 is located substantially entirely inside the interior volume 64 of the socket 16 when the pump 18 is in the retracted position. Conversely, the air intake 70 is preferably located substantially entirely outside the interior volume 64 of the socket 16 when the pump 18 is in the extended position. Also, the air intake 70 is preferably substantially sealed from the ambient air when the pump is in the retracted position. Thus, the fan 24 is protected when the pump 18 is in the retracted position.

The power source of the pump 18 may be a permanent or removable internal battery 80, or an external power source, such as an A/C power cord (not shown). In the case of a removable battery 80, the battery 80 is preferably accessible from an exterior of the inflatable body 12 (and is removable from the pump 18) when the pump 18 is in said extended or intermediate positions.

The switch 82 is biased into an open (off) position by a resilient member, such as a spring, or the like, when the pump 18 is in a deactivated position. The switch 82 is in the closed (on) position when the pump is in an activated position. In this manner, the pump 18 is automatically activated, without further action by the user when the pump 18 is moved to an activated position, wherein the switch 82 is closed. The extended position of the pump 18 is preferably an activated position. The retracted position of the pump 18 is preferably a deactivated position. The intermediate positions of the pump 18 may be entirely activated positions or entirely deactivated positions, or may comprise both activated and deactivated positions.

The switch 82 is preferably disposed on an exterior of the pump 18 in a position and orientation such that a cam follower 98 of the switch 82 engages a switch cam 96 affixed to the socket end plate 19 and is closed thereby, when the pump 18 is in the activated position. Alternately, the switch 82 may be located on an interior surface of the socket 16 in a position and orientation to be engaged and closed by the pump 18 when the pump is in an activated position. As a further alternative, the switch 82 may be user-operable and located on a portion of the pump 18 accessible to the user when the pump is in the extended or intermediate positions. For example, a user-operable switch 82 may be located on the outward face 22 or side wall 72 of the pump 18.

Preferably, the pump 18 includes a plurality of detent projections 100 extending radially outwardly from the inward face 62 of the pump 18, which detent projections 100 engage resilient detent recesses 102 affixed to the socket end plate 19, when the pump 18 is in the extended position to releasably retain the pump 18 in the extended position. The detent projections 100 are disengaged from the detent recesses 102 when the pump 18 is in the intermediate and retracted positions. Thus, the detent projections and recesses 100, 102 serve to reliably maintain the pump in the extended (on) position as long as desired, without monitoring by the user. As can be appreciated, other configurations of the detent structures, such as a reversal of the structures, and other configurations, are within the scope of the invention.

The pump 18 has a sealed position in which the pump 18 substantially blocks, closes or seals the socket outlet 28. The pump 18 also has a displaced position in which the pump 18 is substantially displaced from the socket outlet 28. When the pump 18 is in the sealed position, the pump 18 is in an abutting relationship with the socket outlet 28 and substantially prevents egress of air from the inflatable body 12 through to socket outlet 28. Conversely, when the pump 18 is in the displaced position, the pump allows ingress of air into the inflatable body 12 through the socket outlet 18. The pump 18 is preferably in the sealed position when in the retracted position and is preferably in the displaced position when in the intermediate and extended positions.

The socket 16 may include a sealing recess 90 aligned and/or substantially concentric with the socket outlet 28, which sealing recess 90 may be defined by an annular socket outlet flange 92 surrounding the socket outlet 28 and projecting into the interior volume 64 of the socket 16. The pump 18 may include an annular sealing projection 94 extending from the inward face 62 of the pump 18, and aligned or co-axial with the sealing recess 90. The sealing projection 94 is of a size and shape complementary to a size and shape of the sealing recess 90.

When the pump 18 is in the sealed position, the sealing projection 94 is disposed within the sealing recess 90 and is operable to substantially prevent egress of air from the inflatable body 12 through the socket outlet 28, as described above. When the pump 18 is in the displaced position, the sealing projection 94 is displaced from the sealing recess to permit inflation.

The socket outlet 28 and sealing recess 90 are preferably set-off from the pump outlet 60 a predetermined distance as measured in a direction perpendicular to a direction of travel of the pump 18 within the socket 16. The sealing projection 94 is preferably set-off from the pump outlet 60 a distance equal to that of the predetermined set-off distance of the socket outlet 28. Such that the sealing recess 90 and sealing projection 94 are substantially aligned or co-axial and engaged when the pump 18 is in the sealed position.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. An inflatable product, comprising:

an inflatable body having a wall;

a socket disposed in said wall, said socket extending into an interior of said inflatable body;

a pump slidably disposed in said socket, said pump being slidable from a retracted position to an extended position, said pump being slidably engaged with said socket when in said retracted and extended positions;

said retracted position defining an insertion limit of said pump into said socket and said extended position defining a withdrawal limit of said pump from said socket; and said pump being inoperable in said retracted position and said pump being operable to inflate said inflatable body when said pump is in said extended position.

2. An inflatable product as in claim 1, wherein:

said pump includes a switch operable to activate said pump when said switch is in a closed position;

said switch being in said closed position when said pump is in said extended position; and said switch being in an open position when said pump is in said retracted position.

3. An inflatable product as in claim 2, wherein said switch is in said open position when said pump is in a position intermediate said extended and retracted positions.

4. An inflatable product as in claim 1, wherein:

said pump includes an air intake;

said air intake is in fluid communication with ambient air outside said inflatable body when said pump is in said extended position; and said air intake is substantially sealed from said ambient air when said pump is in said retracted position.

5. An inflatable product as in claim 4, wherein:

said air intake is substantially entirely outside said socket when said pump is in said extended position; and said air intake is substantially entirely inside said socket when said pump is in said retracted position.

6. An inflatable product as in claim 1, wherein:

said socket includes a socket outlet in fluid communication with an interior of said inflatable body;

when said pump is in said extended position, said socket and said pump define a sealed conduit fluidly connecting a pump outlet of said pump to said socket outlet;

whereby said pump is operable to inflate said inflatable body indirectly via said sealed conduit.

7. An inflatable product as in claim 6, wherein:

said socket has an opening through which said pump extends when said pump is in said extended position; and when said pump is in said extended position, said opening is substantially sealed by said pump.

8. An inflatable product as in claim 7, wherein said opening is substantially sealed by said pump when said pump is intermediate said retracted position and said extended position.

9. An inflatable product as in claim 7, wherein:

said socket includes a radially inwardly-extending flange, disposed around a periphery of said opening of said socket;

said pump includes a radially outwardly-extending flange disposed around a periphery of an inward end of said pump;

said outwardly-extending flange of said pump being in a sealingly abutting relationship with said inwardly-extending flange of said socket, when said pump is in said extended position.

10. An inflatable product as in claim 9, further comprising resilient sealing material intermediate said inwardly-extending flange of said socket and said outwardly-flange of said pump.

11. An inflatable product as in claim 6, wherein:

said pump is in a sealingly abutting relationship with said socket outlet when said pump is in said retracted position; and said pump is substantially displaced from said socket outlet when said pump is in said extended position;

whereby said pump substantially prevents egress of air out of said inflatable body through said socket outlet when said pump is in said retracted position and said pump allows ingress of air into said inflatable body through said socket when said pump is in said extended position.

12. An inflatable product as in claim 11, wherein:

said socket includes a scaling recess aligned with said socket outlet;

said pump includes a sealing projection affixed to said pump, said sealing projection being aligned with said scaling recess of said socket;

said sealing projection is sized and shaped complimentary to said sealing recess of said socket;

said sealing projection is disposed within said sealing recess and substantially seals said sealing recess when said pump is in said retracted position; and said sealing projection is substantially displaced from said sealing recess when said pump is in said extended position.

13. An inflatable product as in claim 12, wherein said sealing recess is defined by a socket outlet flange surrounding said socket outlet.

14. An inflatable product as in claim 1, wherein said pump is stowable in said retracted position during use of said inflatable product by a person.

15. An inflatable product, as in claim 1 wherein:

said pump includes a removable battery; and when said pump is in said extended position, said removable battery is accessible from an exterior of said inflatable body and is removable from said pump.

16. An inflatable product, as in claim 15, wherein said removable battery is accessible from an exterior of said inflatable body and is removable from said pump when said pump is intermediate said retracted position and said extended position.

17. An inflatable product, as in claim 1, wherein said pump is substantially entirely outside said socket when in said extended position.

18. An inflatable product as in claim 17, wherein:

said pump includes a switch operable to activate said pump when said switch is in a closed position;

said switch being in said closed position when said pump is in said extended position; and said switch being in an open position when said pump is in said retracted position.

19. An inflatable product as in claim 18, wherein said switch is in said open position when said pump is in a position intermediate said extended and retracted positions.

20. An inflatable product as in claim 17, wherein:

said pump includes an air intake;

said air intake is in fluid communication with ambient air outside said inflatable body when said pump is in said extended position; and said air intake is substantially sealed from said ambient air when said pump is in said retracted position.

21. An inflatable product as in claim 20, wherein:

said air intake is substantially entirely outside said socket when said pump is in said extended position; and said air intake is substantially entirely inside said socket when said pump is in said retracted position.

22. An inflatable product as in claim 17, wherein:

said socket includes a socket outlet in fluid communication with an interior of said inflatable body;

when said pump is in said extended position, said socket and said pump define a scaled conduit fluidly connecting a pump outlet of said pump to said socket outlet;

whereby said pump is operable to inflate said inflatable body indirectly via said sealed conduit.

23. An inflatable product as in claim 22, wherein:

said socket has an opening through which said pump extends when said pump is in said extended position; and when said pump is in said extended position, said opening is substantially sealed by said pump.

24. An inflatable product as in claim 23, wherein said opening is substantially sealed by said pump when said pump is intermediate said retracted position and said extended position.

25. An inflatable product as in claim 23, wherein:

said socket includes a radially inwardly-extending flange, disposed around a periphery of said opening of said socket;

said pump includes a radially outwardly-extending flange disposed around a periphery of an inward end of said pump;

said outwardly-extending flange of said pump being in a sealingly abutting relationship with said inwardly-extending flange of said socket, when said pump is in said extended position.

26. An inflatable product as in claim 25, further comprising resilient sealing material intermediate said inwardly-extending flange of said socket and said outwardly-flange of said pump.

27. An inflatable product as in claim 22, wherein:

said pump is in a sealingly abutting relationship with said socket outlet when said pump is in said retracted position; and said pump is substantially displaced from said socket outlet when said pump is in said extended position;

whereby said pump substantially prevents egress of air out of said inflatable body through said socket outlet when said pump is in said retracted position and said pump allows ingress of air into said inflatable body through said socket when said pump is in said extended position.

28. An inflatable product as in claim 27, wherein:

said socket includes a scaling recess aligned with said socket outlet;

said pump includes a scaling projection affixed to said pump, said scaling projection being aligned with said scaling recess of said socket;

said sealing projection is sized and shaped complimentary to said scaling recess of said socket;

said sealing projection is disposed within said sealing recess and substantially seals said scaling recess when said pump is in said retracted position; and said sealing projection is substantially displaced from said sealing recess when said pump is in said extended position.

29. An inflatable product as in claim 28, wherein said scaling recess is defined by a socket outlet flange surrounding said socket outlet.

30. An inflatable product as in claim 17, wherein said pump is stowable in said retracted position during use of said inflatable product by a person.

31. An inflatable product, as in claim 17 wherein:

said pump includes a removable battery; and when said pump is in said extended position, said removable battery is accessible from an exterior of said inflatable body and is removable from said pump.

32. An inflatable product, as in claim 31, wherein said removable battery is accessible from an exterior of said inflatable body and is removable from said pump when said pump is intermediate said retracted position and said extended position.

* * * * *